US009181796B2

(12) United States Patent
Malone et al.

(10) Patent No.: US 9,181,796 B2
(45) Date of Patent: Nov. 10, 2015

(54) DOWNHOLE SAND CONTROL APPARATUS AND METHOD WITH TOOL POSITION SENSOR

(75) Inventors: Scott Malone, Needville, TX (US); Aleksandar Rudic, Houston, TX (US); Bryan Stamm, Houston, TX (US); Philip Wassouf, London (GB); Dexter Myles Mootoo, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 760 days.

(21) Appl. No.: 13/355,067

(22) Filed: Jan. 20, 2012

(65) Prior Publication Data

US 2012/0186874 A1 Jul. 26, 2012

Related U.S. Application Data

(60) Provisional application No. 61/435,186, filed on Jan. 21, 2011.

(51) Int. Cl.
*E21B 47/04* (2012.01)
*E21B 47/01* (2012.01)

(52) U.S. Cl.
CPC ..... *E21B 47/01* (2013.01); *E21B 47/04* (2013.01)

(58) Field of Classification Search
CPC ..... E21B 47/04
USPC ..... 166/255.1; 175/45
See application file for complete search history.

(56) References Cited

U.S. PATENT DOCUMENTS

| | | | | |
|---|---|---|---|---|
| 3,862,497 | A * | 1/1975 | Vernooy et al. | 33/777 |
| 3,968,568 | A * | 7/1976 | Jackson | 33/777 |
| 4,136,451 | A | 1/1979 | Briand et al. | |
| 4,676,310 | A * | 6/1987 | Scherbatskoy et al. | 340/853.4 |
| 6,041,860 | A | 3/2000 | Nazzal et al. | |
| 6,095,248 | A | 8/2000 | Freeman | |
| 6,190,090 | B1 * | 2/2001 | Campbell et al. | 405/211.1 |
| 6,543,280 | B2 * | 4/2003 | Duhon | 73/152.01 |
| 6,766,857 | B2 | 7/2004 | Bixenman | |

(Continued)

FOREIGN PATENT DOCUMENTS

| | | | |
|---|---|---|---|
| CN | 201208991 | Y | 3/2009 |
| EP | 0999428 | A1 | 5/2000 |

(Continued)

OTHER PUBLICATIONS

Schempf, H., "Explorer II: Wireless Self-Powered Visual and NDE Robotic Inspection System for Live Gas Distribution Mains", Document No. REP-GOV-DOE-051231, Carnegie-Mellon University, The Robotics Insititute—REC, Jan. 31, 2006: pp. 1-40.

(Continued)

*Primary Examiner* — Giovanna C Wright
(74) *Attorney, Agent, or Firm* — Patrick A. Traister; Brandon S. Clark; Jeffery R. Peterson

(57) ABSTRACT

Systems and methods for monitoring a position of a service tool in a wellbore are provided. The service tool can have a sensor assembly coupled thereto and be positioned within the wellbore. The service tool can be moved within the wellbore. The distance travelled by the service tool in the wellbore can be measured with the sensor assembly. The position of the service tool in the wellbore can be determined by comparing the distance travelled to a stationary reference point.

17 Claims, 7 Drawing Sheets

(56) References Cited

U.S. PATENT DOCUMENTS

| | | | | |
|---|---|---|---|---|
| 6,983,796 | B2 | 1/2006 | Bayne et al. | |
| 7,228,898 | B2 | 6/2007 | Grigsby et al. | |
| 7,249,636 | B2 | 7/2007 | Ohmer | |
| 7,316,272 | B2 | 1/2008 | Hurst et al. | |
| 7,525,306 | B2 * | 4/2009 | Brandstrom | 324/207.15 |
| 7,543,641 | B2 | 6/2009 | Contant | |
| 7,712,524 | B2 | 5/2010 | Patel et al. | |
| 7,735,555 | B2 | 6/2010 | Patel et al. | |
| 8,056,628 | B2 | 11/2011 | Whitsitt et al. | |
| 8,082,983 | B2 | 12/2011 | Patel et al. | |
| 8,136,591 | B2 * | 3/2012 | Del Campo et al. | 166/254.2 |
| 8,225,869 | B2 | 7/2012 | Beard et al. | |
| 2002/0007948 | A1 | 1/2002 | Bayne et al. | |
| 2002/0032529 | A1 | 3/2002 | Duhon | |
| 2002/0074119 | A1 | 6/2002 | Bixenman et al. | |
| 2006/0124297 | A1 | 6/2006 | Ohmer | |
| 2007/0235185 | A1 | 10/2007 | Patel et al. | |
| 2008/0128130 | A1 | 6/2008 | Whitsitt et al. | |
| 2009/0033516 | A1 | 2/2009 | Alteirac et al. | |
| 2009/0066535 | A1 | 3/2009 | Patel et al. | |
| 2009/0128141 | A1 | 5/2009 | Hopmann et al. | |
| 2009/0145603 | A1 | 6/2009 | Coronado | |
| 2010/0186953 | A1 | 7/2010 | Patel et al. | |
| 2010/0200291 | A1 | 8/2010 | Patel et al. | |
| 2010/0300685 | A1 * | 12/2010 | Del Campo et al. | 166/254.2 |
| 2011/0241897 | A1 | 10/2011 | Haynes et al. | |
| 2012/0012312 | A1 | 1/2012 | Whitsitt et al. | |
| 2012/0043079 | A1 | 2/2012 | Wassouf et al. | |

FOREIGN PATENT DOCUMENTS

| | | | |
|---|---|---|---|
| WO | 9214027 | A1 | 8/1992 |
| WO | 9613699 | A2 | 5/1996 |
| WO | 2012027283 | A1 | 3/2012 |

OTHER PUBLICATIONS

International Search Report and Written Opinion issued in PCT/US2012/022148 on Aug. 3, 2012, 9 pages.

Russian Official Action for Application 2013138740/03 (058735) dated Jan. 23, 2012. (English Translation).

Russian Decision on Grant for Application 2013138740/03 (058735) dated Apr. 10, 2015 (English Translation).

* cited by examiner

DOWNHOLE SAND CONTROL APPARATUS AND METHOD WITH TOOL POSITION SENSOR

CROSS-REFERENCE TO RELATED APPLICATIONS

This application claims the benefit of and priority to U.S. provisional patent application having Ser. No. 61/435,186 that was filed on Jan. 21, 2011, the entirety of which is incorporated by reference herein.

BACKGROUND

Embodiments described herein generally relate to monitoring the position of a downhole tool in a wellbore. More particularly, the embodiments relate to monitoring the position of a service tool during sand control operations.

Conventional sand control operations have included a service tool and a lower completion assembly. The service tool is coupled to the lower completion assembly, and the two components are run in hole together. Once they reach the desired depth, a packer coupled to the lower completion assembly is set to anchor the lower completion assembly in the wellbore. After the packer is set, the service tool is released from the lower completion assembly. Once released, the service tool can be used in the gravel packing process.

The gravel packing process requires moving the service tool within the wellbore to align one or more crossover ports in the service tool with one or more completion ports in or above the lower completion assembly. As such, aligning the ports requires precise positioning of the service tool. Downhole forces, however, such as pressure, drag on the drillpipe, and/or contraction and expansion of the drillpipe will generally affect the position of the service tool, making it difficult to align the ports. What is needed, therefore, is an improved system and method for monitoring the position of the service tool in the wellbore.

SUMMARY

Systems and methods for monitoring the position of a service tool in a wellbore are provided. In one aspect, the method can be performed by positioning the service tool in the wellbore, and the service tool can have a sensor assembly coupled thereto. The service tool can be moved within the wellbore. The distance travelled by the service tool in the wellbore can be measured with the sensor assembly. The position of the service tool in the wellbore can be determined by comparing the distance travelled to a stationary reference point.

In one aspect, the system can include a completion assembly and a service tool. A packer can be coupled to the completion assembly and adapted to anchor the completion assembly in a stationary position within a wellbore. The service tool can be coupled to the completion assembly, and the service tool can be adapted to release from the completion assembly after the packer is anchored. A sensor assembly can be coupled to the service tool. The sensor assembly can include a wheel that is adapted to contact and roll along a wall of the wellbore as the service tool moves a distance within the wellbore. The sensor assembly can be adapted to measure the distance travelled by the service tool, and the distance can correspond to a number of revolutions of the wheel. The sensor assembly can be adapted to determine a position of the service tool in the wellbore by comparing the distance travelled to a stationary reference point.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

DETAILED DESCRIPTION

Figure 1:
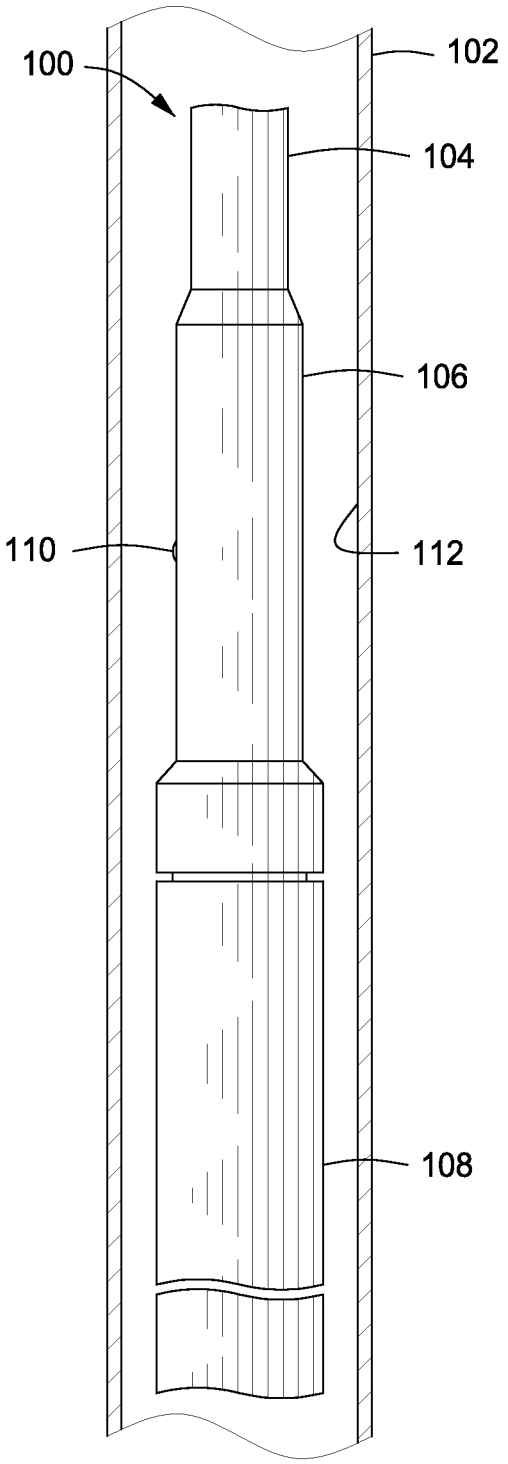
FIG. 1 depicts a cross-sectional view of a downhole tool assembly having a sensor assembly in a disengaged position, according to one or more embodiments described.

FIG. 1 depicts a cross-sectional view of a downhole tool assembly 100 having a sensor assembly 110 in a disengaged position, according to one or more embodiments. The downhole tool assembly 100 can include a workstring 104, a service tool 106, and a lower completion assembly 108. The workstring 104 can be coupled to the service tool 106 and adapted to move the service tool 106 axially and rotationally within a wellbore 102.

The service tool 106 can include one or more tool position sensors or sensor assemblies (one is shown) 110 adapted to monitor the position of the service tool 106 in the wellbore 102. If the service tool 106 includes multiple sensor assemblies 110, the sensor assemblies 110 can be axially and/or circumferentially offset on the service tool 106. The sensor assembly 110 in FIG. 1 is shown in the disengaged position meaning that the sensor assembly 110 is not in contact with a wall 112 of the wellbore 102. As used herein, the wall 112 of the wellbore 102 can include an uncased wall of the wellbore 102 or the inner surface of a casing disposed in the wellbore 102.

Figure 2:
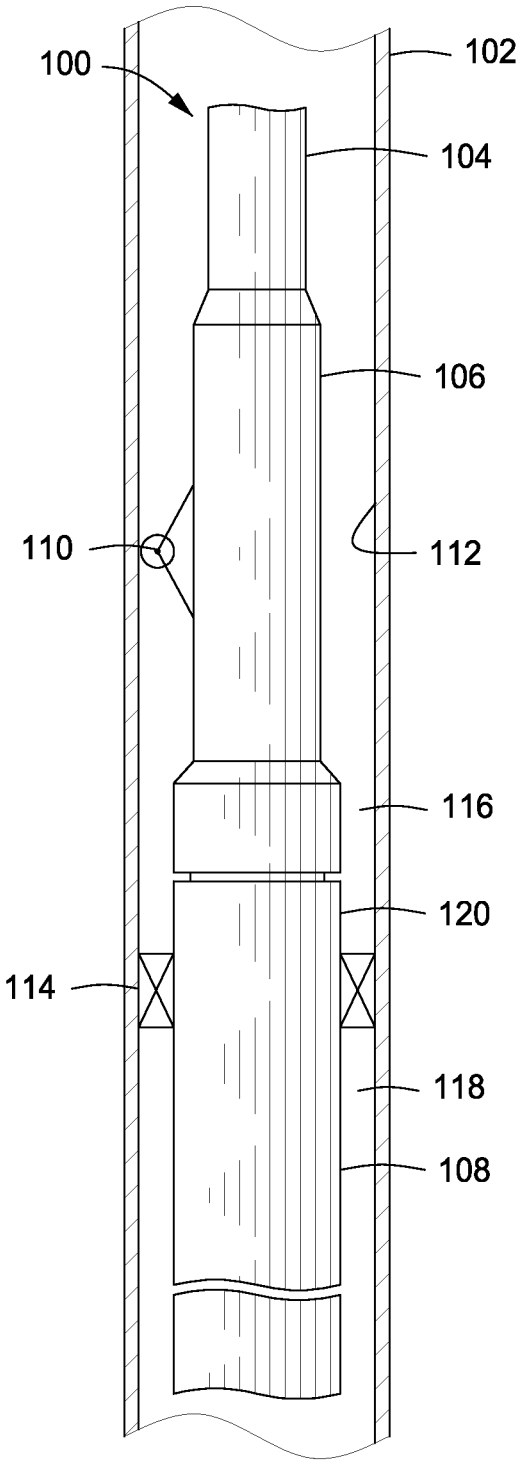
FIG. 2 depicts a cross-sectional view of the downhole tool assembly of FIG. 1 having the sensor assembly in an engaged position, according to one or more embodiments described.

FIG. 2 depicts a cross-sectional view of the downhole tool assembly 100 having the sensor assembly 110 in an engaged position, according to one or more embodiments. The lower completion assembly 108 can include one or more packers 114. In at least one embodiment, the packers 114 can be gravel packers. When the lower completion assembly 108 has been run to the desired depth in the wellbore 102, the packers 114 can be set, as shown in FIG. 2, to anchor the lower completion assembly in place and isolate a first, upper annulus 116 from a second, lower annulus 118.

Once the packers 114 have been set, the sensor assembly 110 can actuate into the engaged position such that at least a portion of the sensor assembly 110, e.g., a wheel as described further below, is in contact with the wall 112 of the wellbore 102. The sensor assembly 110 can be in the engaged position when the service tool 106 is run into the wellbore 102, operated at depth in the wellbore 102, e.g., circulating and reversing, and/or pulled out of the wellbore 102. For example, the sensor assembly 110 can be in the disengaged position when the service tool 106 is run into the wellbore 102, and in the engaged position when the service tool 106 is operated at depth in the wellbore 102 and pulled out of the wellbore 102. In another embodiment, the sensor assembly 110 can be in the disengaged position when the service tool 106 is run into the wellbore 102, in the engaged position while the service tool 106 is operated at depth in the wellbore, and in the disengaged position when the service tool 106 is pulled out of the wellbore 102. The sensor assembly 110 can be actuated into the engaged position by an electric motor, a solenoid, an actuator (including electric, hydraulic, or electro-hydraulic), a timer-based actuator, a spring, pressure within the wellbore 102, or the like. Once in the engaged position, the sensor assembly 110 can maintain contact with the wall 112 of the wellbore 102 via a spring, a wedge, an actuator, a screw jack mechanism, or the like.

The sensor assembly 110 can activate and begin taking measurements to monitor the position of the service tool 106 in the wellbore 102 when the sensor assembly 110 actuates into the engaged position, i.e., contacts the wall 112, or the sensor assembly 110 can activate at a later, predetermined time. For example, the sensor assembly 110 can activate when a predetermined temperature or pressure is reached or when a signal (via cable or wirelessly) is received.

In at least one embodiment, once the sensor assembly 110 is activated, the service tool 106 can release from the lower completion assembly 108 such that that the service tool 106 is free to move axially and rotationally within the wellbore 102 with respect to the stationary lower completion assembly 108. The sensor assembly 110 can be adapted to take measurements to monitor the axial and/or rotational position of the service tool 106 as the service tool 106 is run in the wellbore 102, operated at depth in the wellbore 102, and/or pulled out of the wellbore 102.

Another embodiment of the sensor assembly 110 can also measure rotation of the service tool 106 with respect to the anchored lower completion assembly 108 or reference point 120 in the wellbore 102. In at least one embodiment, the service tool 106 can be released or disconnected from the anchored lower completion assembly 108 by rotating the service tool 106 to unthread it from the lower completion assembly 108. The sensor assembly 110 can be adapted to measure both axial and rotational movement of the service tool 106 with respect to the wellbore 102.

The position of the service tool 106 within the wellbore 102 can be measured with respect to a reference point 120 having a known position within the wellbore 102. For example, the reference point 120 can be located on the stationary lower completion assembly 108. In at least one embodiment, the service tool 106 can be pulled out of the wellbore 102 after it is released from the completion assembly 108, and a second service tool (not shown) can be run in the wellbore 102. The second service tool can also have a sensor assembly coupled thereto and use the reference point 120 on the lower completion assembly 108.

The measurements can be processed in the service tool 106 and/or transmitted to an operator and/or recording device at the surface through a wire or wirelessly. For example, the measurements can be transmitted via wired drill pipe, cable in the workstring 104, cable in the annulus 116, acoustic signals, electromagnetic signals, mud pulse telemetry, or the like. The measurements can be processed in the service tool 106 and/or transmitted to the surface continuously or intermittently to determine the position of the service tool 106 in the wellbore 102. In at least one embodiment, time between the processing and/or transmission of the measurements can be from about 0.5 s to about 2 s, about 2 s to about 10 s, about 10 s to about 30 s, about 30 s to about 60 s (1 min), about 1 min to about 5 min, about 5 min to about 10 min, about 10 min to about 30 min, or more.

Figure 3:
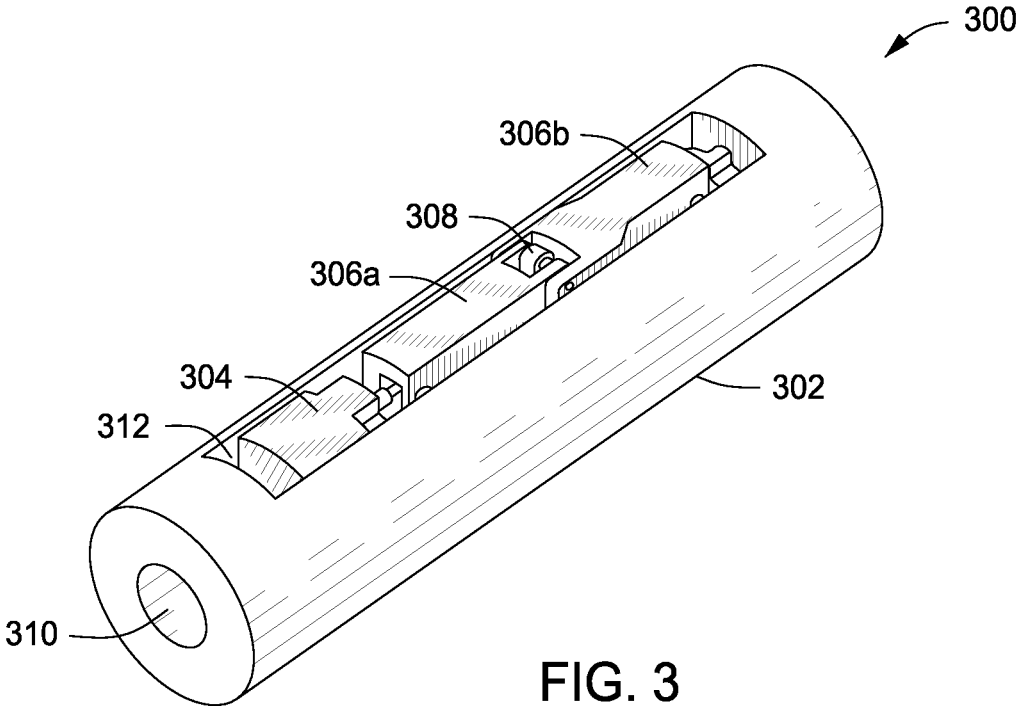
FIG. 3 depicts a perspective view of an illustrative sensor assembly in the disengaged position, according to one or more embodiments described.

FIG. 3 depicts a perspective view of an illustrative sensor assembly 300 in the disengaged position, according to one or more embodiments. The sensor assembly 300 can include a housing 302, a motor 304, one or more arms (two are shown) 306*a*, 306*b*, and one or more wheels (one is shown) 308. The housing 302 can be coupled to or integral with the service tool 106 (see FIG. 1). The housing 302 can be cylindrical with a longitudinal bore 310 extending partially or completely therethrough. The housing 302 can also include a recess 312 in which the motor 304, arms 306*a*, 306*b*, and wheel 308 are disposed when the sensor assembly 300 is in the disengaged position, as shown in FIG. 3.

Figure 4:
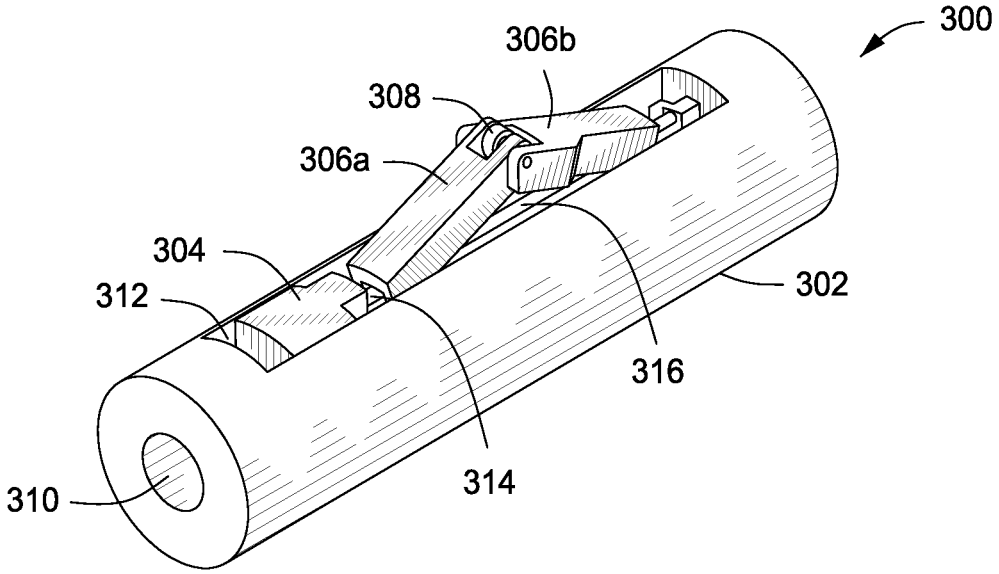
FIG. 4 depicts a perspective view of the illustrative sensor assembly of FIG. 3 in the engaged position, according to one or more embodiments described.

FIG. 4 depicts a perspective view of the illustrative sensor assembly 300 of FIG. 3 in the engaged position, according to one or more embodiments. To actuate the sensor assembly 300 into the engaged position, the motor 304 can move a screw 314 axially along a shaft 316 causing the arms 306*a*, 306*b* to move the wheel 308 radially outward toward the wall 112 of the wellbore 102 (see FIG. 1). Once the wheel 308 is in contact with the wall 112, the motor 304 can be used to control the amount of force applied to the wheel 308 to maintain contact between the wheel 308 and the wall 112. The motor 304 can also be used to retract the wheel 308 back into the disengaged position.

Figure 5:
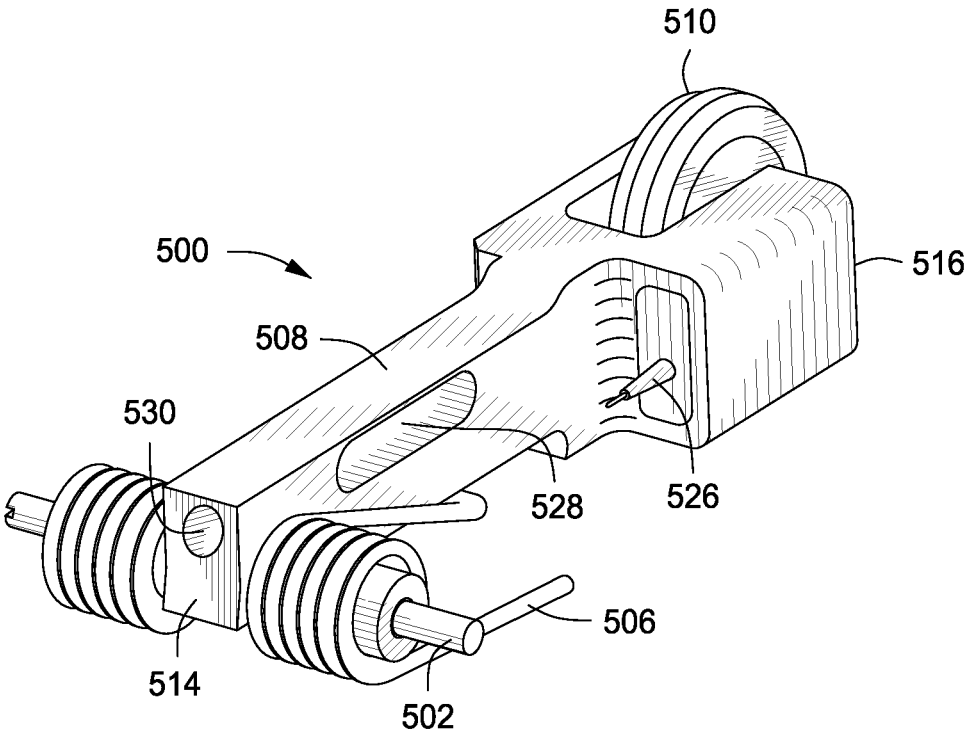
FIG. 5 depicts a perspective view of another illustrative sensor assembly, according to one or more embodiments described.
Figure 6:
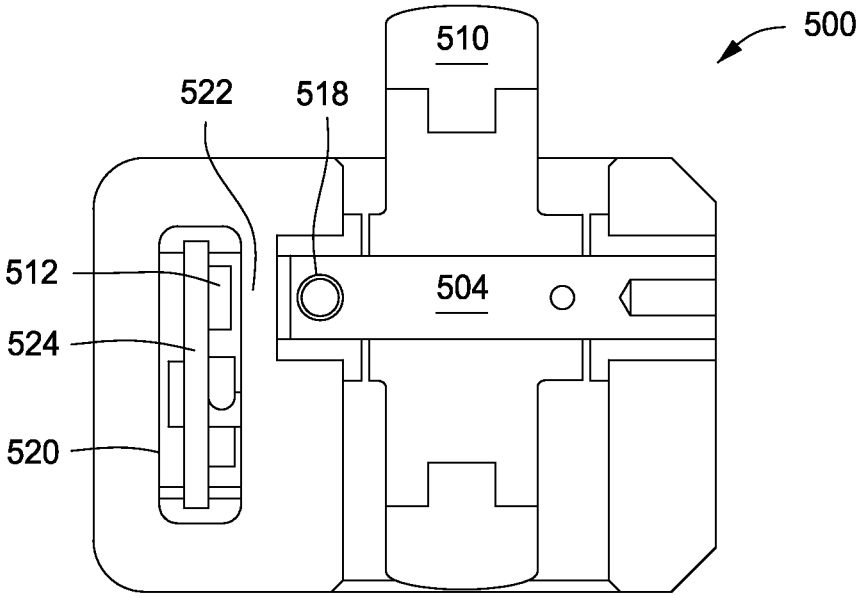
FIG. 6 depicts a cross-sectional view of the sensor assembly of FIG. 5, according to one or more embodiments described.

FIG. 5 depicts a perspective view of another illustrative sensor assembly 500, and FIG. 6 depicts a cross-sectional view of the sensor assembly 500 of FIG. 5, according to one or more embodiments. The sensor assembly 500 can include first and second axles 502, 504 one or more springs (one is shown) 506, an arm or yoke 508, a wheel 510, and one or more sensors (one is shown) 512. The first axle 502 can extend through a first end 514 of the yoke 508, and the spring 506 can be disposed around the first axle 502. The spring 506 can be adapted to actuate and maintain the sensor assembly 500 in the engaged position.

The second axle 504 can be coupled to and extend through the wheel 510 proximate a second end 516 of the yoke 508. When in the engaged position, the wheel 510 can be adapted to roll against the wellbore 102, i.e., roll along the wall 112 of the wellbore 102, as the service tool 106 moves within the wellbore 102 (see FIG. 1). The second axle 504 can be adapted to rotate through the same angular distance as the wheel 510, i.e., one revolution of the wheel 510 corresponds to one revolution of the second axle 504.

In at least one embodiment, one or more magnets (one is shown) 518 can be disposed on or in the second axle 504 and/or the wheel 510 such that the magnet 518 is adapted to rotate through the same angular distance as the wheel 510. As the magnet 504 rotates, the magnetic field produced by the magnet 504 can vary. The sensor 512 can be disposed proximate the magnet 504 and adapted to sense or measure the variations in the magnetic field as the magnet 504 rotates. In at least one embodiment, the sensor 512 can be disposed in an atmospheric chamber 520. As such, a wall 522 can be disposed between the magnet 518 and the sensor 512. The atmospheric chamber 520 can be airtight to prevent fluid from the wellbore 102 from leaking therein.

One or more circuits (one is shown) 524 can also be disposed within the atmospheric chamber 520 and in communication with the sensor 512; however, in at least one embodiment, the sensor 512 and the circuit 524 can be a single component. The circuit 524 can be adapted to receive the measurements from the sensor 512 corresponding to the variations in the magnetic field and determine the number of revolutions and/or partial revolutions completed by the wheel 510. The circuit 524 can then measure the distance travelled by the service tool 106 in the wellbore 102 (see FIG. 1) based upon the number of revolutions and/or partial revolutions completed by the wheel 510, as explained in more detail below.

The number of revolutions completed by the wheel 510 and/or the distance travelled by the service tool 106 can be transmitted to an operator or recording device at the surface through a wire or wirelessly. For example, a cable or wire (not shown) may be adapted to receive signals from the sensor 512 and/or circuit 524 through a bulkhead 526. The cable can run through a channel 528 in the yoke 508 and out an opening 530 through the end 514 of the yoke 508. In at least one embodiment, the yoke 508 can be made of a non-magnetic material. For example, the yoke 508 can be made of a metallic alloy, such as one or more INCONEL® alloys.

Figure 7:
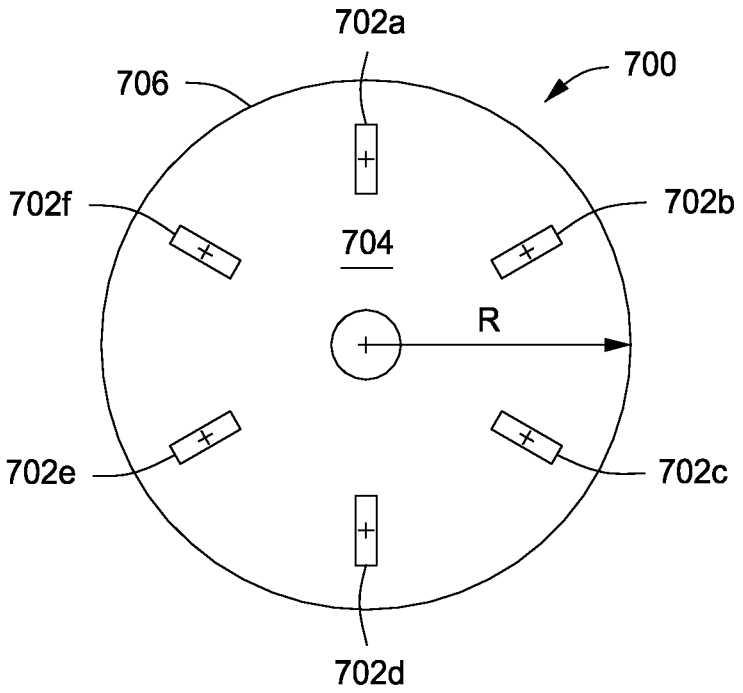
FIG. 7 depicts an illustrative wheel that can be coupled to the sensor assembly, according to one or more embodiments described.

FIG. 7 depicts an illustrative wheel 700 that can be coupled to the sensor assembly 110, 300, 500, according to one or more embodiments. Once in contact with the wall 112 of the wellbore 102 (see FIG. 1), the wheel 700 can be adapted to roll against the wellbore 102 when the service tool 106 moves within the wellbore 102. As the wheel 700 rotates, the axial and/or rotational distance travelled by the service tool 106 can be measured, e.g., by the sensor 512 and/or circuit 524 in FIG. 6. A full revolution of the wheel 700 represents an distance travelled by the service tool 106 calculated by the following equation:

$$D=2*\Pi*R$$

where D is the distance, and Π is the mathematical constant pi, and R is the radius of the wheel 700. The velocity of the service tool 106 in the wellbore 102 can also be calculated the following equation:

$$V=D/t$$

where V is the velocity, D is the distance, and t is time. The acceleration can also be calculated by the following equation:

$$A=V/t$$

where A is the acceleration, V is the velocity, and t is time.

The radius R of the wheel 700 is a known quantity and can range from a low of about 0.05 cm, about 1 cm, about 2 cm, or about 3 cm to a high of about 5 cm, about 10 cm, about 20 cm, about 40 cm, or more. For example, the radius R of the wheel 700 can be from about 1 cm to about 3 cm, about 3 cm to about 6, about 6 cm to about 10 cm, or about 10 cm to about 20 cm.

Figure 8:
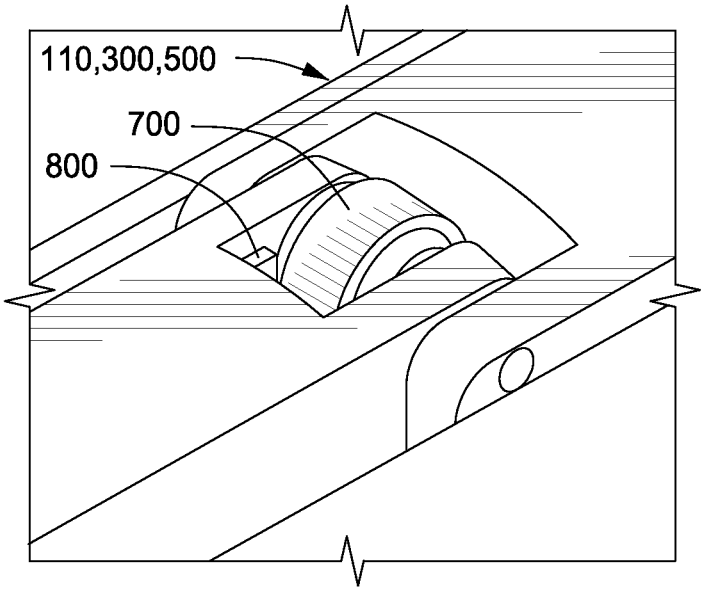
FIG. 8 depicts an illustrative sensor disposed proximate the wheel of FIG. 7, according to one or more embodiments described.

One or more targets (six are shown) 702*a-f* can be disposed at different circumferential positions on the wheel 700. As the number of targets 706*a-f* increases, the precision of the measurement of the distance D can also increase. The distance D travelled by the service tool 106 can be calculated the following equation:

$$D=(2*\Pi*R*S)/N$$

where S is the number of targets 702*a-f* sensed or counted by the sensor, e.g., sensor 800 in FIG. 8, and N is the total number of targets 702*a-f* disposed on the wheel 700. For example, if the wheel 700 rotates half of a revolution, the distance D travelled by the service tool 106 is equal to (2*Π*R*3)/6 because the exemplary wheel 700 includes 6 targets, and 3 targets will be sensed or counted when the wheel 700 rotates half of a revolution. The number N of targets 702*a-f* disposed on the wheel 700 can range from a low of about 1, about 2, about 3, about 4, or about 5 to a high of about 6, about 8, about 10, about 12, about 24, or more. For example, the number N of targets 702*a-f* can be from about 1 to about 12, from about 2 to about 10, or from about 4 to about 6.

The targets 702*a-f* can be disposed on the side or axial end 704 of the wheel 700, as shown, or the targets 702*a-f* can be disposed on the radial end 706 of the wheel 700. For example, the targets 702*a-f* can be disposed within one or more recesses (not shown) on the radial end 706 of the wheel 700 so that the targets 702*a-f* do not come in direct contact with the wall 112 of the wellbore 102 (see FIG. 1) as the wheel 700 rotates. In at least one embodiment, the radial end 706 of the wheel can include a coating or layer having a high coefficient of friction that prevents the wheel 700 from slipping or skidding as the wheel 700 rotates along the wall 112 of the wellbore 102. The coating or layer can also have a high wear resistance to improve longevity.

FIG. 8 depicts an illustrative sensor 800 disposed proximate the wheel 700 of FIG. 7, according to one or more embodiments. The sensor 800 can be disposed on the sensor assembly 110, 300, 500 such that the sensor 800 is stationary with respect to the rotatable wheel 700. Further, the sensor 800 can be disposed on the sensor assembly 110, 300, 500 such that the sensor 800 can sense or count the targets 702*a-f* on the wheel 700 as targets 702*a-f* pass by the sensor 800 when the wheel 700 rotates. Thus, the sensor 800 can be disposed proximate the side 704 of the wheel 700 if the targets 702*a-f* are disposed on the side 704 of the wheel 700, as shown in FIG. 7, or the sensor 800 can be disposed proximate the radial end 706 of the wheel 700 if the targets 702*a-f* are disposed on the radial end 706 of the wheel 700.

The communication between the targets 702*a-f* and the sensor 800 can be magnetic, mechanical, optical, or direct contact. For example, the targets 702*a-f* can be magnets, as described above. In another embodiment, the targets 702*a-f* can be radio frequency identification (RFID) tags. The distance between the sensor 800 and the targets 702*a-f* can range from a low of about 0 cm (direct contact), about 0.1 cm, about 0.2 cm, or about 0.3 cm to a high of about 0.5 cm, about 1 cm, about 5 cm, about 10 cm, or more. For example, the distance between the sensor 800 and the targets 702*a-f* can be from about 0 cm to about 0.2 cm, about 0.2 cm to about 0.5 cm, about 0.5 cm to about 1 cm, or about 1 cm to about 4 cm.

Figure 9:
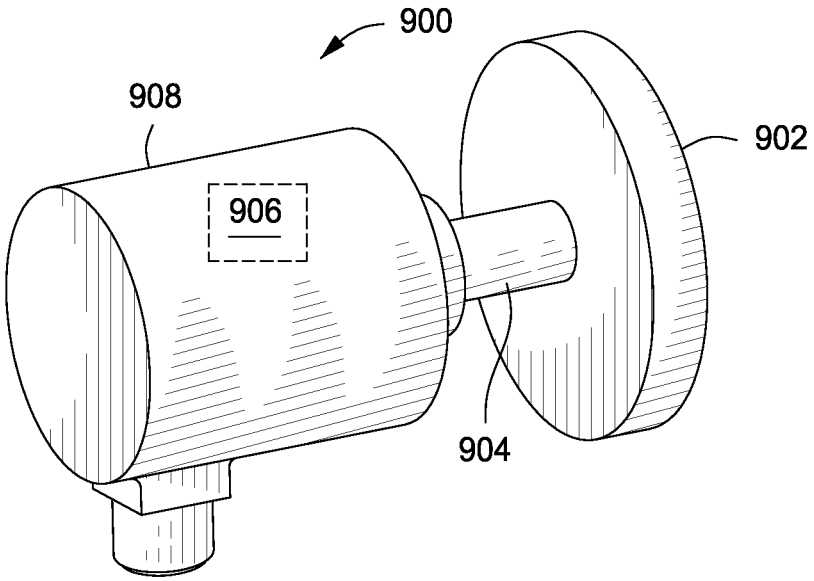
FIG. 9 depicts another illustrative sensor assembly, according to one or more embodiments described.

FIG. 9 depicts another illustrative sensor assembly 900, according to one or more embodiments. The sensor assembly 900 can include a wheel 902, a shaft 904, and a sensor 906 disposed within a housing 908. In the engaged position, the wheel 902 can be in contact with the wall 112 of the wellbore 102 (see FIG. 1) and adapted to rotate when the service tool 106 moves within the wellbore 102. The shaft 904 can be coupled to the wheel 902 and adapted to rotate through the same angular distance as the wheel 902. The shaft 904 can be in communication with the sensor 906 in the housing 908. The sensor 906 can measure the number of revolutions and/or partial revolutions of the shaft 904, which can then be used to calculate the distance D travelled by the service tool 106 in the wellbore 102 (see FIG. 1). The sensor 906 can include a gear tooth counter, an optical encoder, a mechanical encoder, a contact encoder, a resolver, a rotary variable differential transformer (RVDT), a synchro, a rotary potentiometer, or the like.

Figure 10:
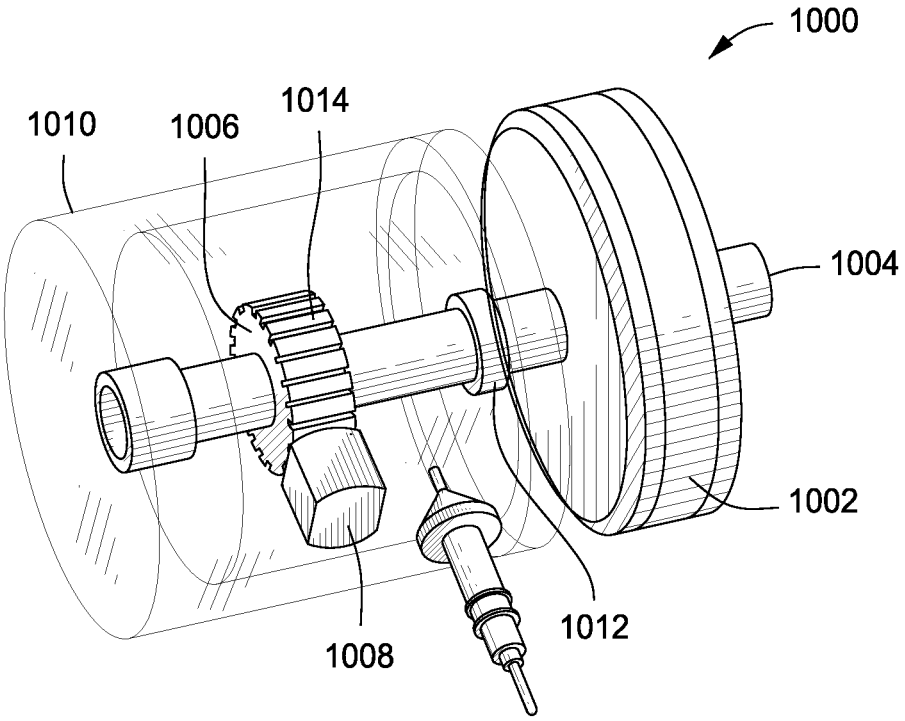
FIG. 10 depicts another illustrative sensor assembly, according to one or more embodiments described.

FIG. 10 depicts another illustrative sensor assembly 1000, according to one or more embodiments. The sensor assembly 1000 can include a wheel 1002, a shaft 1004, a gear 1006, a sensor 1008, and a housing 1010. In the engaged position, the wheel 1002 can be in contact with the wall 112 of the wellbore 102 (see FIG. 1) and adapted to rotate when the service tool 106 moves within the wellbore 102. The shaft 1004 can be coupled to the wheel 1002 and adapted to rotate through the same angular distance as the wheel 1002. The gear 1006 and the sensor 1008 can be disposed within the housing 1010, and a seal 1012, such as a rotary seal, can be used to prevent fluid from entering the housing 1010.

The gear 1006 can be coupled to the shaft 1004 and adapted to rotate through the same angular distance as the shaft 1004. The gear 1006 can include one or more teeth 1014 disposed on an outer radial or axial surface thereof. The number of teeth 1014 can range from a low of about 1, about 2, about 4, about 5, or about 6 to a high of about 8, about 10, about 12, about 20, about 24, or more. For example, the number of teeth 1014 can range from about 1 to about 4, from about 4 to about 8, from about 8 to about 12, or from about 12 to about 24.

The sensor 1008 can be in direct or indirect contact with the gear 1006 and adapted to sense or count the number of teeth 1014 that pass by as the gear 1006 rotates. This measurement can be used to calculate the distance D that the service tool 106 moves in the wellbore 102. This measurement can also be used to calculate the velocity V and/or the acceleration A of the service tool 106 in the wellbore 102. In at least one embodiment, the gear 106 can be in direct contact with the wall 112 of the wellbore 102, and the sensor 1008 can be exposed, i.e., not disposed within the housing 1010.

Figure 11:
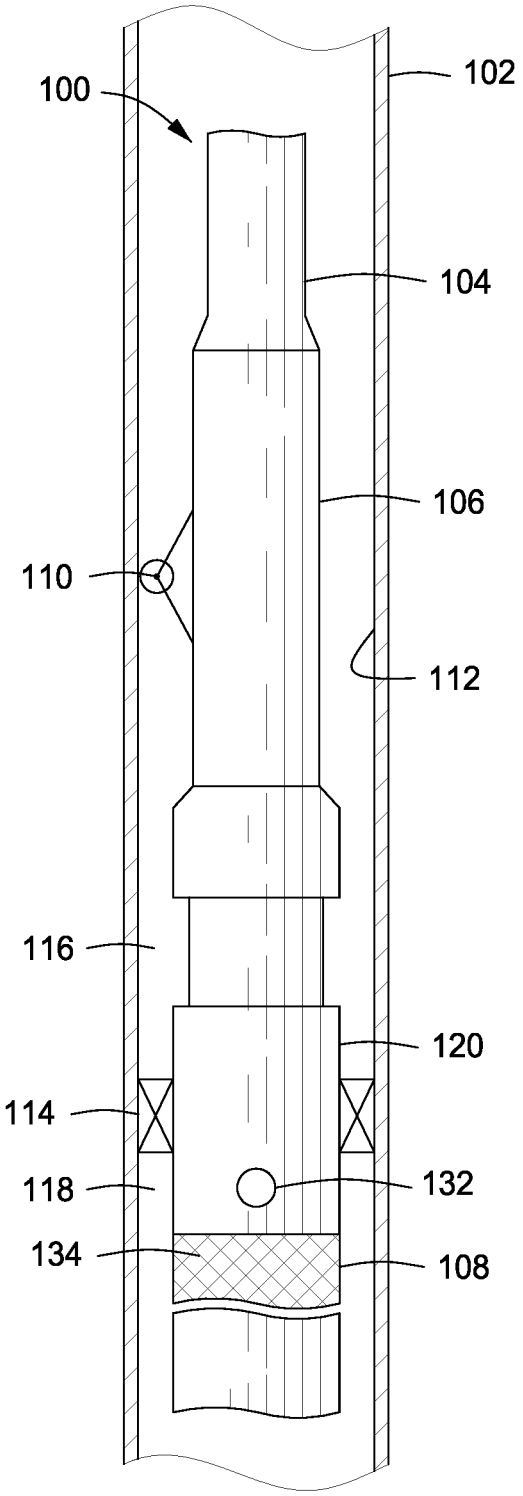
FIG. 11 depicts a cross-sectional view of the service tool in a first, circulating position, according to one or more embodiments described.

FIG. 11 depicts a cross-sectional view of the service tool 106 in a first, circulating position, according to one or more embodiments described. Once the packers 114 have been set and the sensor assembly 110 is in the engaged position and activated, the service tool 106 can be released from the lower completion assembly 108. Once released, rig elevators (not shown) can move the service tool 106 within the wellbore 102. As the service tool 106 moves, the sensor assembly 110 can measure the distance travelled by the service tool 106 in the wellbore 102. For example, the distance travelled can correspond to the number of revolutions of the wheel 308, 510, 700, 902, 1002 in the sensor assembly 110. The position of the service tool 106 in the wellbore 102 can then be determined in relation to the stationary reference point 120.

At least one of (1) the distance travelled by the service tool 106 and (2) the position of the service tool 106 can be transmitted to an operator or recording device at the surface. Once the distance travelled by the service tool 106 and/or position of the service tool 106 are known, the operator or recording device can move the service tool 106 to precise locations within the wellbore 102. For example, the service tool 106 can be moved to the first, circulating position to align one or more one or more crossover ports 130 (see FIG. 12) disposed through the service tool 106 with one or more completion ports 132 disposed through the lower completion assembly 108.

The distance that the service tool 106 needs to travel, e.g., the distance between the ports 130, 132 when the service tool 106 is released from the lower completion assembly 108, can be a known quantity. The sensor assembly 110 can then measure the distance that the service tool 106 travels, to facilitate alignment of the ports 130, 132. For example, the distance between the crossover port 130 and the completion port 132 can be 1 m when the service tool 106 is released from the lower completion assembly 108. If the radius R (also a known quantity) of the wheel 308, 510, 700, 902, 1002 in the sensor assembly 110 is 10 cm (0.1 m), a single revolution of the wheel 308, 510, 700, 902, 1002 represents a distance D travelled calculated by the following equation:

$$D=2*\Pi*R=2*\Pi*0.1=0.628\text{ m}$$

The number of revolutions that the wheel 308, 510, 700, 902, 1002 will have to complete to move the service tool 1 m can be calculated by the following equation:

$$(0.628\text{ m})/(1\text{ revolution})=(1\text{ m})/(X\text{ revolutions})$$

In this exemplary embodiment, X equals about 1.6 revolutions, and thus, when the wheel 308, 510, 700, 902, 1002 completes about 1.6 revolutions, the service tool 106 will have moved 1 m, and the ports 130, 132 will be aligned.

Once the ports 130, 132 are aligned, the lower annulus 118 can be gravel packed. A treatment fluid, such as a gravel slurry including a mixture of a carrier fluid and gravel, can flow through the service tool 106, through the ports 130, 132, and into the lower annulus 118 between one or more screens 134 in the lower completion assembly 108 and the wall 112 of the wellbore 102. A carrier fluid of the gravel slurry can flow back into the service tool 106 leaving the gravel disposed in the annulus 118. The gravel forms a permeable mass or "pack" between the one or more screens 134 and the wall 112 of the wellbore 102. The gravel pack allows production fluids to flow therethrough while substantially blocking the flow of any particulate material, e.g., sand.

At certain times during use of the service tool 106, the service tool 106 can move axially within the wellbore 102 due to various forces acting on it. The forces can include pressure, drag on the workstring 104, and contraction and expansion of the workstring 104 due to temperature changes. For example, during the circulation process, the net pressure forces on the service tool 106 can push the service tool 106 upward in the wellbore 102. This upward movement of the service tool 106 can be compounded by the contraction of the workstring 104 as it cools during pumping. The sensor assembly 110 can be used to determine the position of the service tool 106 in the wellbore 102 both axially and rotationally, and in response to the determined position, additional weight and/or rotation can be added or removed at the surface to maintain the service tool 106 in the desired position, e.g., with the ports 130, 132 aligned. The monitoring of the position of the service tool 106 and corresponding variation of weight at the surface can be used for other operations as well, including when the service tool 106 is in the secondary release, squeeze, dump seal, or reversing positions.

Figure 12:
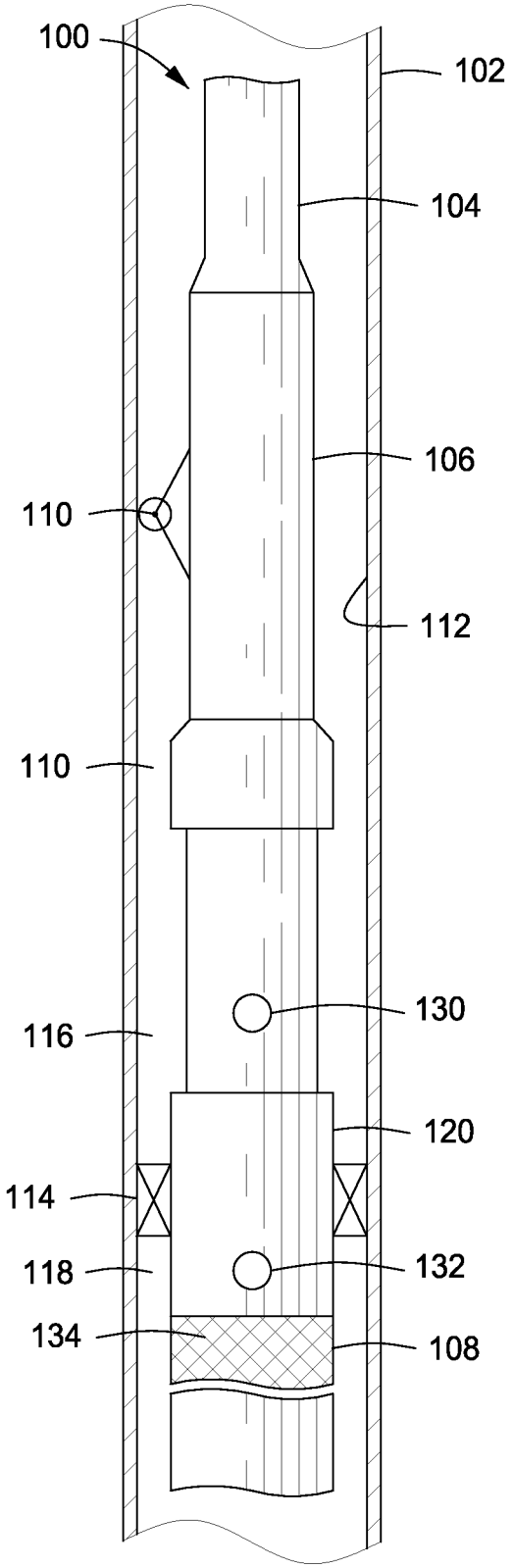
FIG. 12 depicts a cross-sectional view of the service tool in a second, reversing position, according to one or more embodiments described.

FIG. 12 depicts a cross-sectional view of the service tool 106 in a second, reversing position, according to one or more embodiments. After circulation of the service fluid, the service tool 106 can move within the wellbore 102 into a reversing position where the crossover port 130 is positioned above the packers 114. For example, the distance between the crossover port 130 and the packers 114 can be 2 m, and as such, an operator may decide that the service tool needs to be moved up 2.5 m to place the crossover port 130 above the packers 114. Continuing with the example above having a wheel with a radius R of 10 cm, the number of revolutions that the wheel 308, 510, 700, 902, 1002 will have to complete to move the service tool 2.5 m can be calculated by the following equation:

$$(0.628\text{ m})/(1\text{ revolution})=(2.5\text{ m})/(X\text{ revolutions})$$

where X is the number of revolutions of the wheel. For example, when X equals about 4 revolutions, and thus, when the wheel 308, 510, 700, 902, 1002 completes about 4 revolutions, the service tool 106 will have moved 2.5 m, and the crossover port 130 will be in the desired positioned above the packers 114.

Once in the reversing position, pressure can be applied to the upper annulus 116 to reverse the remaining gravel slurry in the service tool 106 back to the surface. The high pressure in the upper annulus 116 can force a wellbore fluid in the annulus 116 through the port 130, thereby forcing the gravel slurry in the service tool 106 to the surface. With the position of the service tool 106 known, the pumping can begin as soon as the service tool 106 enters the reversing position and before annular pressure bleeds off completely.

Figure 13:
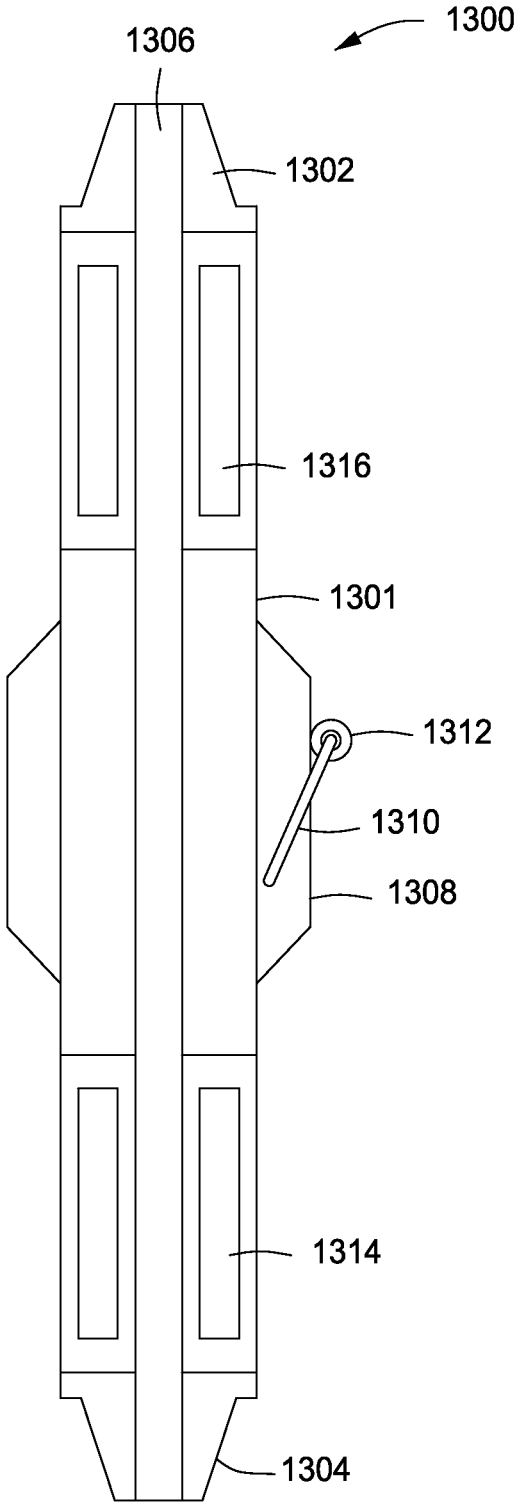
FIG. 13 depicts a cross-sectional view of another illustrative sensor assembly, according to one or more embodiments described.

FIG. 13 depicts a cross-sectional view of another illustrative sensor assembly 1300, according to one or more embodiments. The sensor assembly 1300 can be coupled to or integral with the service tool 106. For example, the sensor assembly 1300 can include a housing 1301 having first and second connectors 1302, 1304 adapted to connect the sensor assembly 1300 to the service tool 106. The sensor assembly 1300 can also include a bore 1306 extending partially or completely therethrough. At least a portion of the sensor assembly 1300 can include a stand-off 1308 that extends radially outward from the remaining portion of the sensor assembly 1300.

The sensor assembly 1300 can include an arm or yoke 1310 having a wheel 1312 coupled thereto. The yoke 1310 and wheel 1312 can be substantially similar to the yoke 508 and wheel 510 described above, and thus will not be described again in detail. One or more electronic components 1314 can be disposed within the housing 1301. The electronic components 1314 can include one or more circuits adapted to receive the data from the wheel 1312, e.g., the number of revolutions. In at least one embodiment, the electronic components 1314 can be adapted to measure the distance travelled by the service tool 106 based on the data from the wheel 1312. In another embodiment, the electronic components 1314 can be adapted to measure the distance travelled by the service tool 106 and determine the position of the service tool 106 in the wellbore 102 based upon the distance measurements. As described above, the electronic components can be adapted to transmit the distance travelled and/or the position of the service tool 106 in the wellbore to an operator or recording device at the surface.

One or more batteries 1316 can also be disposed within the housing 1301. For example, the batteries 1316 can form an annular battery pack within the housing 1301. The batteries 1316 can be adapted to supply power to the yoke 1310, the motor actuating the yoke 1310, the electronic components 1314, or other downhole devices.

Referring again to FIGS. 1, 2, 11, and 12, the sensor assembly 110 can be used to monitor and identify when the service tool 106 starts, stops, or otherwise moves, to more accurately determine the up, down, and neutral weights used at the surface. This data can then be correlated against engineering prediction models, in real time or post-job history matching, to calibrate the models. Calibration can be achieved by varying one or more variables, such as pumping/fluid viscous friction factors in the casing or an openhole section, until the prediction matches the actual measurement.

The sensor assembly 110 described herein can be used by any downhole tool to measure downhole distances and determine downhole positions. For example, the sensor assembly 110 can be used in a centralizer used in other wireline tools, drilling and measurement logging tools, shifting tools, and fishing tools that are used to, for example, create logs of information about the adjacent formation or map the adjacent formation. As such, the position of the downhole tool can be correlated with logs, maps, or the like.

Alternative technologies for measuring and monitoring the position of the service tool 106 in the wellbore 102 can include acoustic, magnetic, and electromagnetic techniques. The position of the service tool 106 can also be measured and monitored with a linear variable differential transformer or a tether or cable coupled to the service tool 106. For example, one end of a tether can be coupled to the service tool 106, and the other end of the tether can be coupled to the stationary lower completion assembly 108 or packers 114. The tether can be in tension as the service tool 106 moves within the wellbore 102. Thus, as the service tool 106 moves with respect to the stationary lower completion assembly 108 or packers 114, the length of the tether can vary. The length of the tether can be measured to determine the position of the service tool 106 in the wellbore 102. Upon completion of the job, the tether can be released or severed from the lower completion assembly 108 or packers 114 allowing the service tool 106 to be pulled out of the wellbore 102.

In another embodiment, the sensor assembly 110 can include an acoustic sensor or transceiver, and the reference point 120 can include a target. The target 120 can be placed on the stationary lower completion assembly 108 or the packers 114. The sensor assembly 110 can be adapted to send acoustic signals to and receive acoustic signals from the target 120. The signals can be used to determine a distance travelled by the service tool 106 and/or the position of the service tool 106 in the wellbore 102. At least one of the distance travelled and the position of the service tool 106 can then be transmitted to an operator or recorder at the surface, and once the position is known or determined (based on the distance travelled), the service tool 106 can be moved to precise locations within the wellbore 102.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for monitoring a position of a service tool in a wellbore, comprising:

positioning the service tool having a sensor assembly coupled thereto within the wellbore, wherein the sensor assembly comprises a wheel that rolls against the wellbore as the service tool moves within the wellbore;

moving the service tool within the wellbore;

measuring a distance travelled by the service tool in the wellbore with the sensor assembly by sensing variations in a magnetic field produced by a magnet that rotates through the same angular distance as the wheel, wherein the magnet is disposed on or in an axle that extends through the wheel; and determining the position of the service tool in the wellbore by comparing the distance travelled to a stationary reference point, wherein the distance travelled corresponds to a number of revolutions of the wheel.

2. The method of claim 1, wherein the sensor assembly comprises an acoustic sensor.

3. The method of claim 1, wherein the measured distance is at least one of an axial distance and a rotational distance.

4. The method of claim 1, further comprising calculating at least one of a velocity of the service tool in the wellbore and an acceleration of the service tool in the wellbore.

5. The method of claim 1, further comprising:

transmitting at least one of the measured distance and the position of the service tool to at least one of an operator and a recorder; and moving the service tool in the wellbore in response to at least one of the transmitted distance travelled and the transmitted position of the service tool.

6. The method of claim 1, wherein the service tool comprises at least one of a wireline tool, a shifting tool, a fishing tool, and a drilling and measurement logging tool.

7. A method for monitoring a position of a service tool in a wellbore, comprising:

positioning the service tool having a sensor assembly coupled thereto within the wellbore, wherein the sensor assembly comprises a wheel that rolls against the wellbore as the service tool moves within the wellbore;

moving the service tool within the wellbore;

measuring a distance travelled by the service tool in the wellbore with the sensor assembly; and determining the position of the service tool in the wellbore by comparing the distance travelled to a stationary reference point, wherein the distance travelled corresponds to a number of revolutions of the wheel, and wherein the stationary reference point is disposed on a stationary completion assembly.

8. A method for monitoring a position of a service tool in a wellbore, comprising:

running a downhole tool assembly into the wellbore, wherein the downhole tool assembly comprises the service tool coupled to a completion assembly, wherein the service tool comprises a sensor assembly, and wherein the completion assembly comprises a packer;

setting the packer at a fixed position in the wellbore, thereby making the completion assembly stationary within the wellbore;

actuating the sensor assembly into an engaged position such that a wheel of the sensor assembly is in contact with a wall of the wellbore;

releasing the service tool from the completion assembly after the packer is set such that the service tool is adapted to move within the wellbore with respect to the stationary completion assembly;

moving the service tool within the wellbore with respect to the stationary completion assembly, wherein the wheel is adapted to roll along the wall of the wellbore as the service tool moves;

measuring a distance travelled by the service tool in the wellbore, wherein the distance corresponds to a number of revolutions of the wheel; and determining the position of the service tool in the wellbore in relation to the fixed position of the completion assembly.

9. The method of claim 8, further comprising transmitting at least one of the distance travelled by the service tool in the wellbore and the position of the service tool in the wellbore to at least one of an operator and a recorder.

10. The method of claim 9, further comprising moving the service tool in the wellbore in response to at least one of the transmitted distance travelled and the transmitted position of the service tool to align one or more crossover ports disposed through the service tool with one or more completion ports disposed through the completion assembly.

11. The method of claim 10, further comprising flowing a treatment fluid through the one or more crossover ports and the one or more completion ports and into an annulus formed between the completion assembly and the wall of the wellbore and below the packer.

12. The method of claim 11, further comprising moving the service tool into a reversing position such that the one or more crossover ports are disposed above the packer.

13. A downhole tool assembly, comprising:

a completion assembly;

a packer coupled to the completion assembly and adapted to anchor the completion assembly in a stationary position within a wellbore;

a service tool coupled to the completion assembly, wherein the service tool is adapted to release from the completion assembly after the packer is anchored; and a sensor assembly coupled to the service tool, wherein the sensor assembly comprises a wheel that is adapted to contact and roll along a wall of the wellbore as the service tool moves a distance within the wellbore, wherein the sensor assembly is adapted to measure the distance travelled by the service tool, wherein the distance corresponds to a number of revolutions of the wheel, and wherein the sensor assembly is adapted to determine a position of the service tool in the wellbore by comparing the distance travelled to a stationary reference point.

14. The downhole tool assembly of claim 13, wherein the sensor assembly further comprises:

an axle extending through the wheel; and a magnet disposed on or in at least one of the axle and the wheel, wherein the magnet is adapted to rotate through the same angular distance as the wheel.

15. The downhole tool assembly of claim 14, wherein the sensor assembly further comprises a sensor adapted to sense variations in a magnetic field produced by the magnet as the magnet rotates.

16. The downhole tool assembly of claim 15, further comprising a circuit in communication with the sensor.

17. The downhole tool assembly of claim 16, wherein at least one of the sensor and the circuit is disposed in an atmospheric chamber.

* * * * *